US009808849B2

(12) United States Patent
Kohno

(10) Patent No.: US 9,808,849 B2
(45) Date of Patent: Nov. 7, 2017

(54) SLIDE CUSHION DEVICE OF PRESS MACHINE

(71) Applicant: AIDA ENGINEERING, LTD., Sagamihara-shi, Kanagawa (JP)

(72) Inventor: Yasuyuki Kohno, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 0 days.

(21) Appl. No.: 15/366,237

(22) Filed: Dec. 1, 2016

(65) Prior Publication Data

US 2017/0151600 A1 Jun. 1, 2017

(30) Foreign Application Priority Data

Dec. 1, 2015 (JP) ..... 2015-234450

(51) Int. Cl.
*B21D 24/08* (2006.01)
*B21D 24/02* (2006.01)
*B21D 24/14* (2006.01)

(52) U.S. Cl.
CPC ..... *B21D 24/02* (2013.01); *B21D 24/08* (2013.01); *B21D 24/14* (2013.01)

(58) Field of Classification Search
CPC ..... B21D 24/02; B21D 24/08; B21D 24/14
USPC ..... 72/453.13
See application file for complete search history.

(56) References Cited

U.S. PATENT DOCUMENTS 2,233,164 A * 2/1941 Glasner ..... B21D 24/02 267/119
3,425,257 A 2/1969 Heiser
3,435,653 A 4/1969 Scaletta et al.
5,457,980 A 10/1995 Kirii et al.
5,687,598 A * 11/1997 Kirii ..... B21D 24/14 72/21.5

(Continued)

FOREIGN PATENT DOCUMENTS

EP 0531141 A1 3/1993
JP 60-171628 U 11/1985

(Continued)

OTHER PUBLICATIONS

Extended European Search Report issued in corresponding EP Application No. 16200859.3, dated May 3, 2017.

(Continued)

*Primary Examiner* — David B Jones

(74) *Attorney, Agent, or Firm* — McDermott Emery & Will LLP

(57) ABSTRACT

A slide cushion device includes: a hydraulic cylinder group integrally formed in a board provided immediately below a slide; a pressing member that is disposed in a recessed portion of an upper die that vertically moves together with the slide, in a vertically movable manner; a plurality of slide cushion pins that is provided in the pressing member and penetrates the upper die to be brought into contact with a piston member of the hydraulic cylinder group, wherein a number of the cushion pins is less than a number of hydraulic cylinders disposed in a plane of projection of the recessed portion; and a slide cushion hydraulic device that controls hydraulic pressure to be supplied to a compression chamber of the hydraulic cylinder with which a slide cushion pin is to be brought into contact.

12 Claims, 9 Drawing Sheets

(56) References Cited

U.S. PATENT DOCUMENTS

| | | | | | |
|---|---|---|---|---|---|
| 5,701,778 | A * | 12/1997 | Kirii | B21D 24/14 72/351 |
| 5,960,665 | A * | 10/1999 | Schoellhammer | B21D 24/14 72/351 |
| 5,966,981 | A | 10/1999 | Janos et al. | |
| 8,037,735 | B2 * | 10/2011 | Kohno | B21D 24/02 72/351 |
| 2009/0071218 | A1 | 3/2009 | Kohno et al. | |

FOREIGN PATENT DOCUMENTS

| | | | |
|---|---|---|---|
| JP | 05-192715 | A | 8/1993 |
| JP | 06-190464 | A | 7/1994 |
| JP | 08-090096 | A | 4/1996 |
| JP | 2006-061920 | A | 3/2006 |
| JP | 2006-315074 | A | 11/2006 |

OTHER PUBLICATIONS

Office Action issued in corresponding Japanese Patent Application No. 2015-234450, dated May 19, 2017 with partial English language translation.

* cited by examiner

SLIDE CUSHION DEVICE OF PRESS MACHINE

BACKGROUND OF THE INVENTION

Field of the Invention

The present invention relates to a slide cushion device of a press machine, and more particularly to a slide cushion device of a press machine, the slide cushion device pressing from above an area in a recessed portion of an upper die for a material to be press-formed.

Description of the Related Art

In recent years, forming of a high-tensile steel plate by using a press machine has become common, and a function of a slide (upper side) cushion that presses from above an area in a recessed portion of an upper die for the high-tensile steel plate during press forming is important to improve formability of the high-tensile steel plate.

Conventionally, there is provided a device for a press die that is to be used by being attached to a press machine, and that includes a work holding pad for holding a work, the work holding pad being movable up and down (refer to Japanese Patent Application Laid-Open No. 2006-061920 (Patent Literature 1)).

The device for a press die described in Patent Literature 1 is applicable to both a press machine with a cushion function and a press machine without the cushion function, and particularly in a case of a press machine with cushion means, the device includes a die body, a pad body attached to the die body so as to be detachable and movable up and down, and a pressing force transmitting rod that is provided in the pad body and a press machine side by penetrating through the die body.

The cushion means includes a base plate attached to a slide (ram) of the press machine, and a plurality of rod-less cylinders fitted into the base plate. The pressing force transmitting rod is attached at its one end to the pad body, and has the other end that is brought into contact with the rod-less cylinder of the cushion means, thereby transmitting pressing force to the pad body from the slide through the rod-less cylinder.

In an embodiment of Patent Literature 1, there is described the cushion means in which six rod-less cylinders are fitted into the base plate, the rod-less cylinders each being a gas enclosed type.

In addition, Patent Literature 1 describes the cushion means that is configured so that dies different in size can be attached to the cushion means (refer to FIGS. 15 and 16 in Patent Literature 1) to allow the cushion means to have versatility.

SUMMARY OF THE INVENTION

Patent Literature 1 describes the cushion means to which dies different in size can be attached, and FIGS. 15 and 16 each in Patent Literature 1 illustrate the pressing force transmitting rods attached to the pad body, the number of rods varying according to a size of a die (or the pad body attached to the die body so as to be movable up and down). This is caused because the number of rod-less cylinders disposed in a plane of projection of the pad body varies according to a size of the die, so that the number of pressing force transmitting rods to be disposed corresponding one-to-one to the rod-less cylinders also varies.

That is, the pressing force transmitting rods attached to the pad body correspond one-to-one to the rod-less cylinders disposed in the plane of projection of the pad body, and Patent Literature 1 discloses no idea of appropriately adjusting the number and placement of the pressing force transmitting rods to be attached to the pad body.

The cushion means described in Patent Literature 1 includes the plurality of rod-less cylinders fitted into the base plate, and thus the number of components increases to cause the base plate to increase in thickness. In addition, since the rod-less cylinder is a gas enclosed type, there is a problem in that increase in pressure with a cushion stroke during press forming, and residual cushion pressure after forming, have no small adverse effect on forming.

The present invention is made in light of the above-mentioned circumstances, and it is an object thereof to provide a slide cushion device of a press machine that is capable of appropriately adjusting the number and placement of cushion pins for each die when pressing from above an area in a recessed portion of an upper die for a material to be press-formed, and that is capable of generating cushion pressure with a quick response, controlling pressure to be substantially constant without increasing in pressure, and releasing pressure after forming, whereby the cushion device has favorable formability and is inexpensive.

To achieve the object described above, a slide cushion device of a press machine according to an aspect of the present invention includes: a plurality of hydraulic cylinders integrally formed in a board included in a slide of the press machine, or in a board provided immediately below the slide; a pressing member that is disposed in a recessed portion of an upper die that vertically moves together with the slide, in a vertically movable manner, and that presses a material with a projecting portion of a lower die facing the upper die; a plurality of cushion pins that is provided in the pressing member and penetrates the upper die to be brought into contact with a piston member of the hydraulic cylinder, wherein a number of the plurality of cushion pins is less than a number of hydraulic cylinders disposed in a plane of projection of the recessed portion of the upper die; and a slide cushion hydraulic device that controls at least hydraulic pressure that is to be supplied to a compression chamber of the hydraulic cylinder with which the cushion pins are to be brought into contact.

According to the aspect of the present invention, the plurality of hydraulic cylinders is configured to be integrally formed in the board constituting the slide of the press machine, or the board provided immediately below the slide, and thus many hydraulic cylinders can be disposed, the number of components can be reduced (the device can be inexpensive), and height of the slide cushion device can be minimum.

In addition, the number and placement of the cushion pins provided in the pressing member, the cushion pins penetrating the upper die to be brought into contact with the piston member of the hydraulic cylinder, can be appropriately adjusted corresponding to the upper die (pressing member), and the number thereof is adjusted to a number less than at least the number of hydraulic cylinders disposed in a plane of projection of the recessed portion of the upper die. Conversely, the number of hydraulic cylinders integrally formed in the board is set so that the number and placement of the cushion pins can be adjusted.

Further, the slide cushion hydraulic device controls at least hydraulic pressure to be supplied to the compression chamber of the hydraulic cylinder with which the cushion pin is to be brought into contact, and thus slide cushion pressure can be controlled to be substantially constant without increasing with a forming stroke, and die cushion pressure can be reduced from when the slide of the press machine reaches a bottom dead center after forming is completed, thereby contributing to forming.

The former reduces a degree of stress concentrated at a limited portion of a material in a final stage of forming to prevent the material from breaking, and the latter prevents the pressing member from having an adverse effect on a product, such as a case where the pressing member acts on (clings to) the upper die through a product, while the slide of the press machine is rising, to cause the product to be unintentionally deformed.

In a slide cushion device of a press machine according to another aspect of the present invention, it is preferable that the number of hydraulic cylinders N is ten or more. That is because if the number of hydraulic cylinders is less than ten, a degree of freedom of the number and placement of the cushion pins decreases.

In a slide cushion device of a press machine according to yet another aspect of the present invention, it is preferable that total maximum thrust N×f of the N hydraulic cylinders is 1.5 times or more maximum slide cushion force on specifications, where maximum thrust of one of the plurality of hydraulic cylinders is indicated as f.

In a slide cushion device of a press machine according to yet another aspect of the present invention, it is preferable that the slide cushion hydraulic device includes a cushion pressure generating line, and a system pressure acting line in which operation fluid is held under a predetermined system pressure, and that the compression chamber of each of the plurality of hydraulic cylinders is connected to the cushion pressure generating line or the system pressure acting line through any one of a plurality of changeover valves equal in number to the plurality of hydraulic cylinders, or is connected to the cushion pressure generating line or the system pressure acting line through any one of the plurality of changeover valves less in number than the plurality of hydraulic cylinders.

In a slide cushion device of a press machine according to yet another aspect of the present invention, it is preferable that the slide cushion hydraulic device includes a cushion pressure generating line, and a system pressure acting line in which operation fluid is held under predetermined system pressure, and that the compression chamber of each of the plurality of hydraulic cylinders is directly connected to the cushion pressure generating line. This enables cushion pressure generated in the cushion pressure generating line to be applied to the compression chamber of each of the plurality of hydraulic cylinders in advance, thereby enabling the cushion pressure to be generated with a quick response.

In a slide cushion device of a press machine according to yet another aspect of the present invention, it is preferable that an accumulator configured to hold the operation fluid under system pressure within a range from 0.3 MPa to 10.0 MPa is connected to the system pressure acting line. This enables decrease in response time of increasing pressure when pressure in the compression chamber of each of the plurality of hydraulic cylinders is increased to desired cushion pressure.

In a slide cushion device of a press machine according to yet another aspect of the present invention, it is preferable that the slide cushion hydraulic device includes: a logic valve of a pilot drive type that is provided between the cushion pressure generating line and the system pressure acting line, and that is operable as a main relief valve when slide cushion pressure acts; and a pilot relief valve that is provided between the cushion pressure generating line and the system pressure acting line to generate pilot pressure that controls the logic valve. This enables the slide cushion hydraulic device to increase pressure in the compression chamber of each of the plurality of hydraulic cylinders to desired cushion pressure and hold the desired cushion pressure without requiring a driving source such as a hydraulic pump for applying pressure to the operation fluid when the slide cushion pressure acts, whereby the slide cushion hydraulic device becomes inexpensive.

In a slide cushion device of a press machine according to yet another aspect of the present invention, the slide cushion hydraulic device includes a first solenoid valve that switches pressure to be applied to a pilot port of the logic valve to any one of the pilot pressure and the system pressure. When the first solenoid valve is switched to apply the pilot pressure to the pilot port of the logic valve, slide cushion pressure corresponding to the pilot pressure can be generated in the cushion pressure generating line. In addition, when the first solenoid valve is switched so that the system pressure is applied to the pilot port of the logic valve, the slide cushion pressure generated in the cushion pressure generating line can be reduced to the system pressure. Further, when force pressing the pressing member from below is reduced in the state above (when the press tunes to rise from the bottom dead center), the slide cushion pressure can be completely reduced (to zero), and can be locked near the press bottom dead center.

In a slide cushion device of a press machine according to yet another aspect of the present invention, it is preferable that the slide cushion hydraulic device includes a second solenoid valve that is provided between the cushion pressure generating line and the system pressure acting line to open and close a line between the cushion pressure generating line and the system pressure acting line. Controlling the second solenoid valve enables descending operation (operation of pushing out a product) of the piston member serving as a slide cushion pad. In addition, operation of the second solenoid valve and a throttle valve connected to the second solenoid valve in series enables descending speed to be adjusted by adjusting opening of the throttle valve.

In a slide cushion device of a press machine according to yet another aspect of the present invention, it is preferable to include a controller configured to control the first solenoid valve and the second solenoid valve, wherein the controller controls the first solenoid valve so that the pilot pressure is applied to the pilot port of the logic valve during a descending period of the slide, and the second solenoid valve so that the second solenoid valve is opened during a rising period of the slide. Since the controller performs only simple control of the first and second solenoid valves (a special control device is unnecessary), a part of a controller of the press machine (a programmable logic controller (PLC)) can be used for the controller, and a cam switch that is opened to a customer in the press machine to drive a peripheral device of the press machine, and a device associated with a die, and that is capable of outputting a plurality of contact signals in accordance with a crank angle (an angle between 0-degree and 360-degree) of the press machine, can be used as the controller, for example, whereby the controller is inexpensive.

The cam switch is configured by using a mechanical type switch (old type) using a mechanical contact of each of a plurality of limit switches, or a controller (e.g. PLC) of the press machine. When the controller (e.g. PLC) of the press machine is directly used for slide cushion control, involvement by a press manufacturer is required, however, using the cam switch increases convenience, such as requirement of only control by a user.

In a slide cushion device of a press machine according to yet another aspect of the present invention, it is preferable that the cushion pressure generating line is connected through a check valve to a cushion pressure preceding pressurization line through which operation fluid pressurized by an external hydraulic device can be supplied, and that the system pressure acting line is connected through a relief valve to a preceding pressurized fluid volume discharge line. In addition, it is preferable that a solenoid valve (fourth solenoid valve) is provided downstream of the relief valve.

Pressurized operation fluid can be supplied from the external hydraulic device through the cushion pressure preceding pressurization line, and thus pressure in the cushion pressure generating line (or the compression chamber of the hydraulic cylinder) can be increased to more than system pressure before slide cushion pressure acts, whereby when pressure in the compression chamber of each of the plurality of hydraulic cylinders is increased to desired cushion pressure, response time of increasing pressure can be reduced more. When the operation fluid is supplied from the external hydraulic device through the cushion pressure preceding pressurization line as described above, an amount of operation fluid in the slide cushion hydraulic device increases (the system pressure increases), and then the increased operation fluid is discharged from the preceding pressurized fluid volume discharge line through the relief valve. In addition, it is preferable to use a die cushion hydraulic device of a die cushion device for the external hydraulic device. The die cushion hydraulic device has a period (surplus period) in which a die cushion function is not exerted, before the slide cushion pressure acts, and thus the die cushion hydraulic device can supply pressurized operation fluid through the cushion pressure preceding pressurization line during the surplus period.

In a slide cushion device of a press machine according to yet another aspect of the present invention, the slide cushion hydraulic device is filled with pressurized operation fluid, and no hydraulic pump for pressurizing and supplying the operation fluid is provided between the cushion pressure generating line and the system pressure acting line. When the slide cushion pressure acts, the logic valve operates as a main relief valve to enable slide cushion pressure corresponding to pilot pressure generated by the pilot relief valve to be generated, and descending operation of the piston member, including operation of pushing out a product, can be performed by using operation fluid under the system pressure accumulated in the accumulator, whereby a hydraulic pump is unnecessary. As described above, since a hydraulic pump is unnecessary, power cost can be saved.

According to the present invention, when an area in a recessed portion of an upper die for a material to be press-formed is pressed from above by the pressing member, the number and placement of cushion pins for the pressing member can be appropriately adjusted for each die while a degree of freedom is increased. In addition, cushion pressure is generated with a quick response, substantially constant cushion pressure can be controlled, the cushion pressure can be reduced after forming is finished, and an inexpensive device can be achieved.

BRIEF DESCRIPTION OF THE DRAWINGS

Portion (A) in FIG. 9 is a waveform chart illustrating slide position, slide cushion position, die cushion position, slide cushion pressure, system pressure, and die cushion pressure, in one cycle period of the press machine, and Portions (B) to (F) in FIG. 9 are timing charts illustrating timing of ON/OFF operation of a first solenoid valve, a second solenoid valve, a fourth solenoid valve, and a second changeover valve, respectively.

DETAILED DESCRIPTION OF THE EMBODIMENTS

With reference to accompanying drawings, preferable embodiments of a slide cushion device of a press machine according to the present invention will be described below in detail.

[Structure of Whole of Press Machine]

<Press Machine>

Figure 1:
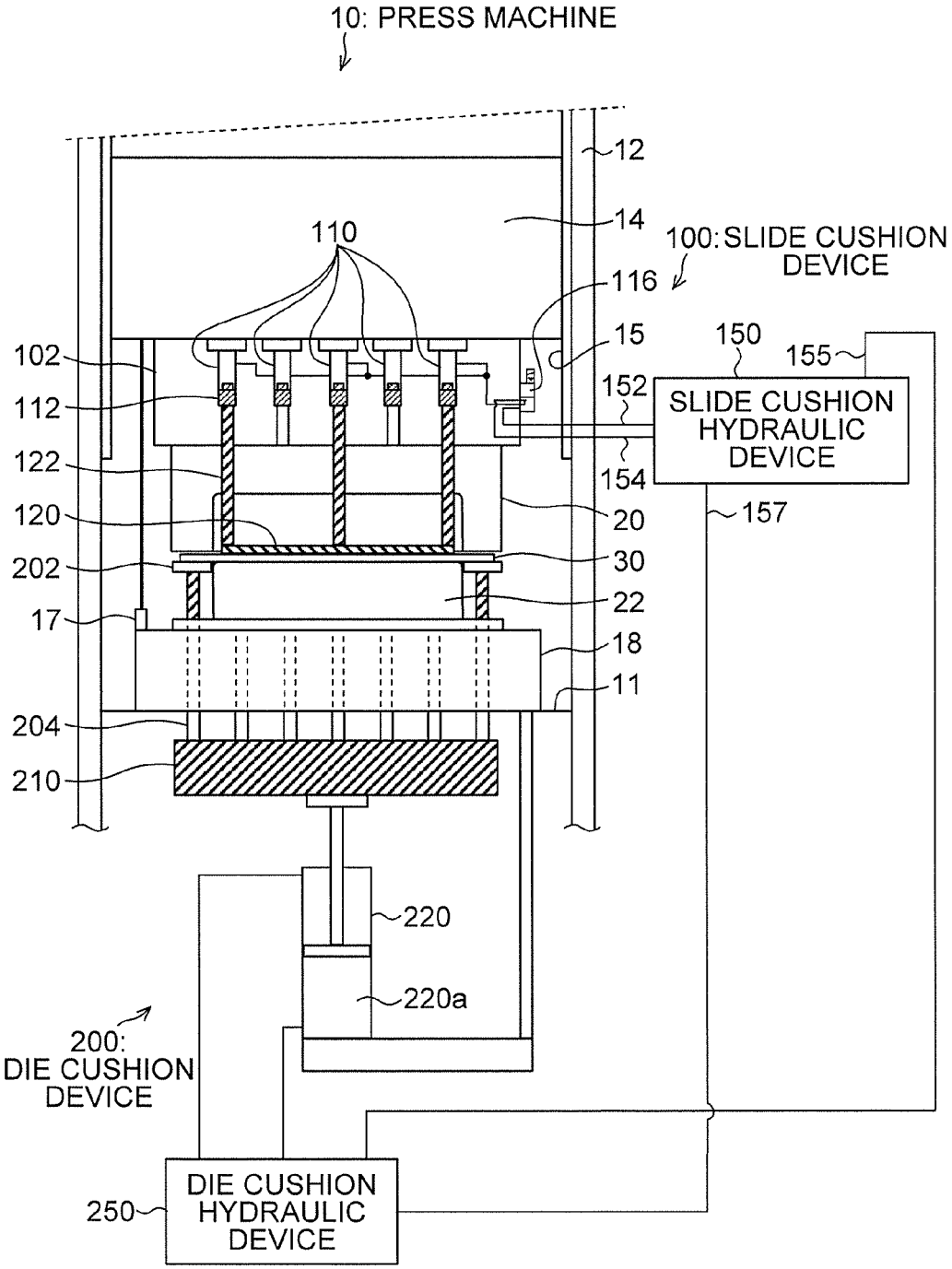
FIG. 1 is a schematic structural view of the whole of a press machine including a slide cushion device according to the present invention.

FIG. 1 is a schematic structural view of the whole of a press machine including a slide cushion device according to the present invention.

In FIG. 1, a press machine 10 includes a frame including a bed 11, a column 12, and a crown (not illustrated), and a slide 14 that is movably guided in a vertical direction by a guide section 15 provided in the column 12. The slide 14 is moved in the vertical direction in FIG. 1 by a servo motor (not illustrated), or a crank mechanism including a crankshaft to which rotational driving force is transmitted by a flywheel (not illustrated).

It is preferable that a slide position detector 17 for detecting a position of the slide 14 is provided on a bed 11 side of the press machine 10, or that the crankshaft of the crank mechanism is provided with a crankshaft encoder for detecting a crank angle.

A board 102 constituting a slide cushion device 100 is provided immediately below the slide 14, an upper die 20 is mounted on a lower surface of the board 102, and a lower die 22 facing the upper die 20 is mounted on a bolster 18 of the bed 11. The upper die 20 is a dicing die with a recessed portion, and the lower die 22 is a punching die with a projecting portion corresponding to the recessed portion of the upper die 20.

A blank holder (blank holding plate) 202 is disposed between the upper die 20 and the lower die 22, and its lower side is supported by a die cushion pad 210 through a plurality of die cushion pins 204 and a material 30 is set on (brought into contact with) its upper side.

The press machine 10 lowers the slide 14 to press-form the material 30 between the upper die 20 and the lower die 22.

The slide cushion device 100 described later presses from above an area in the recessed portion of the upper die for the material 30 to be press-formed, and a die cushion device 200 presses the peripheral edge of the material 30 from below. Particularly, if the material 30 is a high-tensile steel plate, the slide cushion device 100 contributes to improvement in formability of the material 30.

<Slide Cushion Device>

The slide cushion device 100 includes: a plurality of hydraulic cylinders (hydraulic cylinder group) 110 that is integrally formed in the board 102 provided immediately below the slide 14; a pressing member 120 that is disposed in the recessed portion of the upper die 20 in a vertically movable manner; a plurality of slide cushion pins (cushion pin) 122 that is provided in the pressing member 120; and a slide cushion hydraulic device (slide cushion fluid-pressure device) 150.

Figure 2:
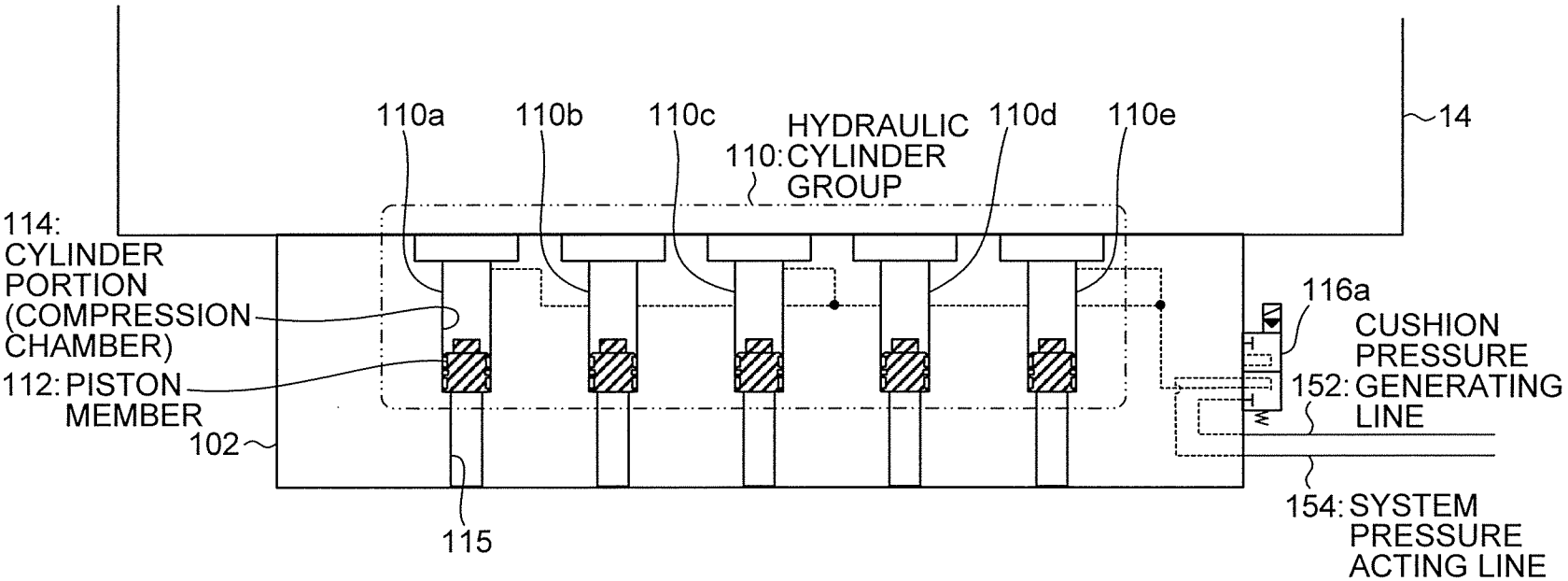
FIG. 2 is an enlarged view of a main section of the slide cushion device illustrated in FIG. 1, including a hydraulic cylinder group.
Figure 3:
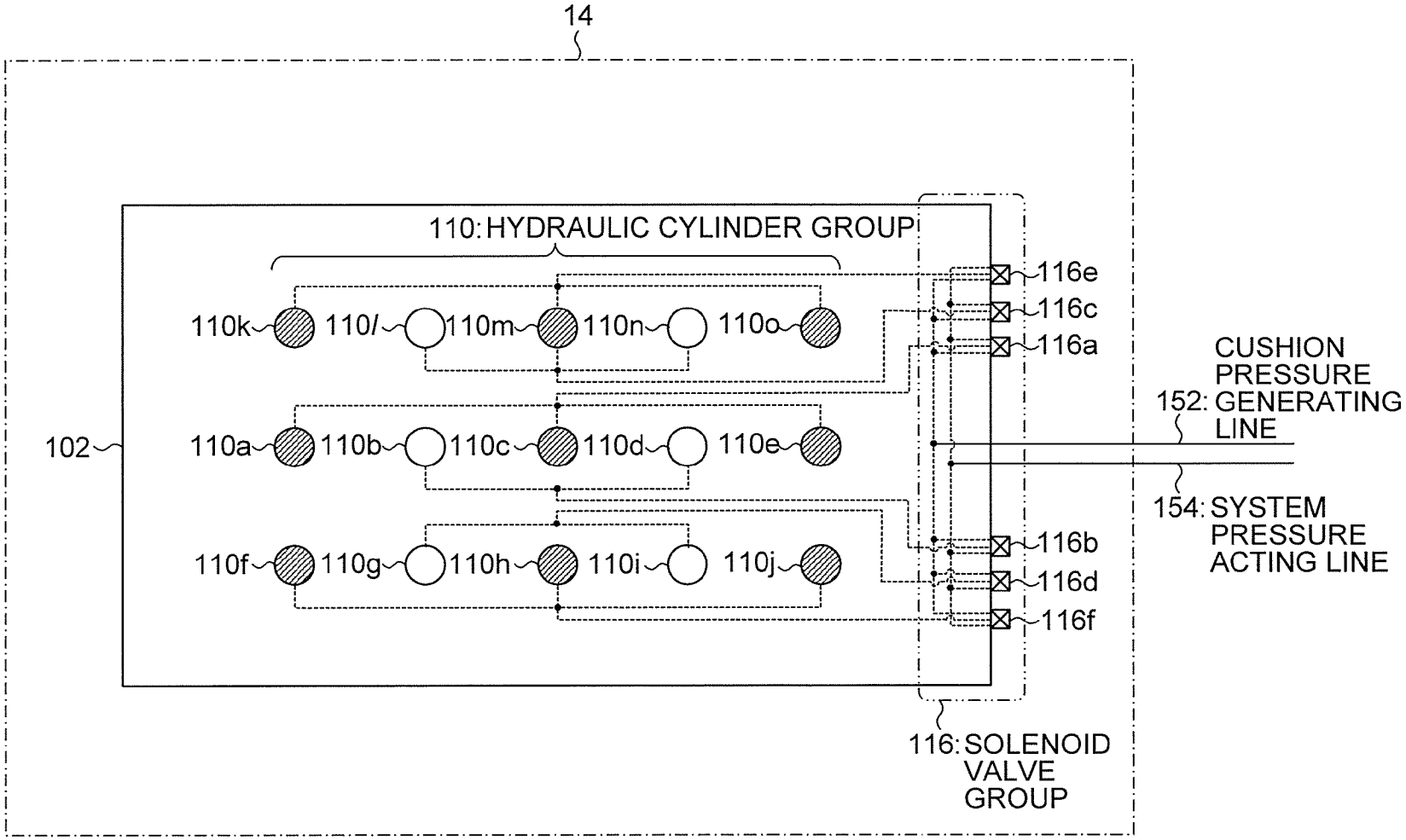
FIG. 3 is a plan view of the main section illustrated in FIG. 2.

FIG. 2 is an enlarged view of a main section of the slide cushion device illustrated in FIG. 1, including the hydraulic cylinder group. FIG. 3 is a plan view of the main section illustrated in FIG. 2.

As illustrated in FIGS. 2 and 3, cylinder portions 114 of respective fifteen hydraulic cylinders 110*a* to 110*o* (hydraulic cylinder group 110) are integrally formed in the board (block) 102 immediately below the slide by working the board 102, and a piston member 112 is housed in each of the cylinder portions 114 to constitute the hydraulic cylinder group 110. A compression chamber of the hydraulic cylinder is formed between the cylinder portion 114 and an upper face of the piston member 112.

In the board 102, a cushion pin hole 115 communicating with the cylinder portion 114 is formed. The slide cushion pin 122 is inserted into the cushion pin hole 115 that is formed smaller in diameter than the cylinder portion 114. This allows a contact face to be formed at a lower end of the cylinder portion 114 to restrict a descending end of the piston member 112, as illustrated in FIG. 2.

Since the hydraulic cylinder group 110 is integrally formed in the board 102 as described above, fastening members at end portions are reduced in number as compared with a case where a finished hydraulic cylinder is embedded in a board. Thus the board 102 can be reduced in height and the number of components can be reduced, whereby the device can be inexpensive.

As illustrated in FIG. 3, the respective compression chambers of the hydraulic cylinder group 110 are connected to a cushion pressure generating line 152 or a system pressure acting line 154 through a plurality of third solenoid valves 116*a* to 116*f* (solenoid valve group 116) each serving as a changeover valve.

In an example illustrated in FIG. 3, the compression chamber of each of the hydraulic cylinders 110*a*, 110*c*, and 110*e* is connected to the third solenoid valve 116*a* through an oil passage formed in the board 102, and the compression chamber of each of the hydraulic cylinders 110*b* and 110*d* is connected to the third solenoid valve 116*b* through an oil passage formed in the board 102. Likewise, the compression chamber of each of the hydraulic cylinders 110*f*, 110*h*, and 110*j* is connected to the third solenoid valve 116*f* through an oil passage formed in the board 102, the compression chamber of each of the hydraulic cylinders 110*g* and 110*i* is connected to the third solenoid valve 116*d* through an oil passage formed in the board 102, the compression chamber of each of the hydraulic cylinders 110*k*, 110*m*, and 110*o* is connected to the third solenoid valve 116*e* through an oil passage formed in the board 102, and the compression chamber of each of the hydraulic cylinders 1101 and 110*n* is connected to the third solenoid valve 116*c* through an oil passage formed in the board 102.

The solenoid valve group 116 is controlled to be turned on and off corresponding to the hydraulic cylinder in the hydraulic cylinder group 110, to be used when slide cushion pressure acts. When the nine hydraulic cylinders of the hydraulic cylinders 110*a*, 110*c*, and 110*e*, the hydraulic cylinders 110*f*, 110*h*, and 110*j*, and the hydraulic cylinders 110*k*, 110*m*, and 110*o*, are used, for example, the third solenoid valves 116*a*, 116*f*, and 116*e* are turned on so that the compression chamber of each of the hydraulic cylinders is connected to the cushion pressure generating line 152, and the other third solenoid valves 116*b*, 116*c* and 116*d* are turned off so that the compression chamber of each of the hydraulic cylinders 110*b* and 110*d*, the hydraulic cylinders 110*l* and 110*n*, and the hydraulic cylinders 110*g* and 110*i*, corresponding to the third solenoid valves, is connected to the system pressure acting line 154.

Returning to FIG. 1, the pressing member 120 is disposed in the recessed portion of the upper die 20 in a vertically movable manner and presses the material 30 from above while the material 30 is nipped between the pressing member 120 and the projecting portion of the lower die 22, when slide cushion pressure acts. The pressing member 120 is disposed so that a stopper (not illustrated) prevents the pressing member 120 from dropping from the upper die 20.

Each of the slide cushion pins 122 transmits slide cushion force to the pressing member 120 from the hydraulic cylinder group 110, and is provided in the pressing member 120 and penetrates through the upper die 20, and then is inserted into the cushion pin hole 115 (refer to FIG. 2) of the board 102 to be brought into contact with the piston member 112 of the hydraulic cylinder.

The slide cushion pins 122 are adjusted to a number less than the number of hydraulic cylinders in the hydraulic cylinder group disposed in a plane of projection of the recessed portion of the upper die 20.

In the present embodiment, the number of hydraulic cylinders in the hydraulic cylinder group 110 disposed in a plane of projection of the recessed portion of the upper die 20 is 15 (=3×5) (refer to FIG. 3). The number of hydraulic cylinders in the hydraulic cylinder group 110, to be used for slide cushion pressure action, is less than the number (15) of hydraulic cylinders in the hydraulic cylinder group 110, and can be set to 9 (=3×3) hydraulic cylinders disposed in odd-numbered rows in the hydraulic cylinder group 110 composed of 3-by-5 hydraulic cylinders, for example.

In this case, the slide cushion pins 122 are adjusted in number and position so as to correspond one-to-one to 9 hydraulic cylinders in the hydraulic cylinder group 110, to be used for the slide cushion pressure action, and are disposed.

As described above, the slide cushion pins 122 can be appropriately adjusted in number and placement within a range of the number and placement of hydraulic cylinders in the hydraulic cylinder group 110 formed in the board 102, and thus an optimum number of slide cushion pins can be disposed at optimum positions for each die.

Thus, it is preferable that N is 10 or more where the number of hydraulic cylinder group is indicated as N. That is because if N is less than 10, a degree of freedom the number and placement of slide cushion pins decreases, whereby a variety of dies cannot be handled.

Conversely, the number of slide cushion pins is based on the premise that the slide cushion pins are less in number than hydraulic cylinders in the hydraulic cylinder group. That is because if the slide cushion pins are equal in number to the hydraulic cylinders in the hydraulic cylinder group, there is no degree of freedom of the number and placement of slide cushion pins.

If maximum thrust of one of the hydraulic cylinders in the hydraulic cylinder group is indicated as f, total maximum thrust of N hydraulic cylinders in the hydraulic cylinder group is represented as "N×f". The total maximum thrust "N×f" is 1.5 times or more total slide cushion force (maximum slide cushion force on specifications).

That is, since all of the N hydraulic cylinders in the hydraulic cylinder group are not used for slide cushion pressure action, the slide cushion force can be less than the maximum slide cushion force on specifications. When one hydraulic cylinder is used at the maximum thrust f, the number of available slide cushion pins is two-thirds or less of the number N of hydraulic cylinders in the hydraulic cylinder group.

The slide cushion hydraulic device 150 generates fluid-pressure (hydraulic pressure or oil pressure) to be supplied to a compression chamber of each hydraulic cylinder in the hydraulic cylinder group 110, used during slide cushion pressure action. Accordingly, slide cushion force to be applied to the pressing member 120 through hydraulic cylinders in the hydraulic cylinder group, used during the slide cushion pressure action, and the slide cushion pins 122, is generated during press forming. Details of the slide cushion hydraulic device 150 will be described later.

<Die Cushion Device>

The die cushion device 200 includes the blank holder 202, the die cushion pad 210 that supports the blank holder 202 through the plurality of die cushion pins 204, a hydraulic cylinder (fluid-pressure cylinder) 220 that supports the die cushion pad 210 and allows the die cushion pad 210 to generate die cushion force, and a die cushion hydraulic device 250.

While the die cushion device described in Japanese Patent Application Laid-Open No. 2006-315074 is available as the die cushion device 200, besides this, a known die cushion device is available.

The die cushion hydraulic device 250 can serve as an external hydraulic device for the slide cushion hydraulic device 150. While the die cushion hydraulic device 250 has a period (surplus period) in which a die cushion function is not exerted, before the slide cushion pressure acts, the die cushion hydraulic device 250 can supply pressure oil pressurized through a cushion pressure preceding pressurization line 155 during the surplus period. Hydraulic oil increased in the slide cushion hydraulic device 150 is discharged into a low-pressure line in the die cushion hydraulic device 250 through a preceding pressurized fluid volume discharge line (preceding pressurized oil volume discharge line) 157. Details of operation of the cushion pressure preceding pressurization line 155 and the preceding pressurized oil volume discharge line 157 will be described later.

Figure 4:
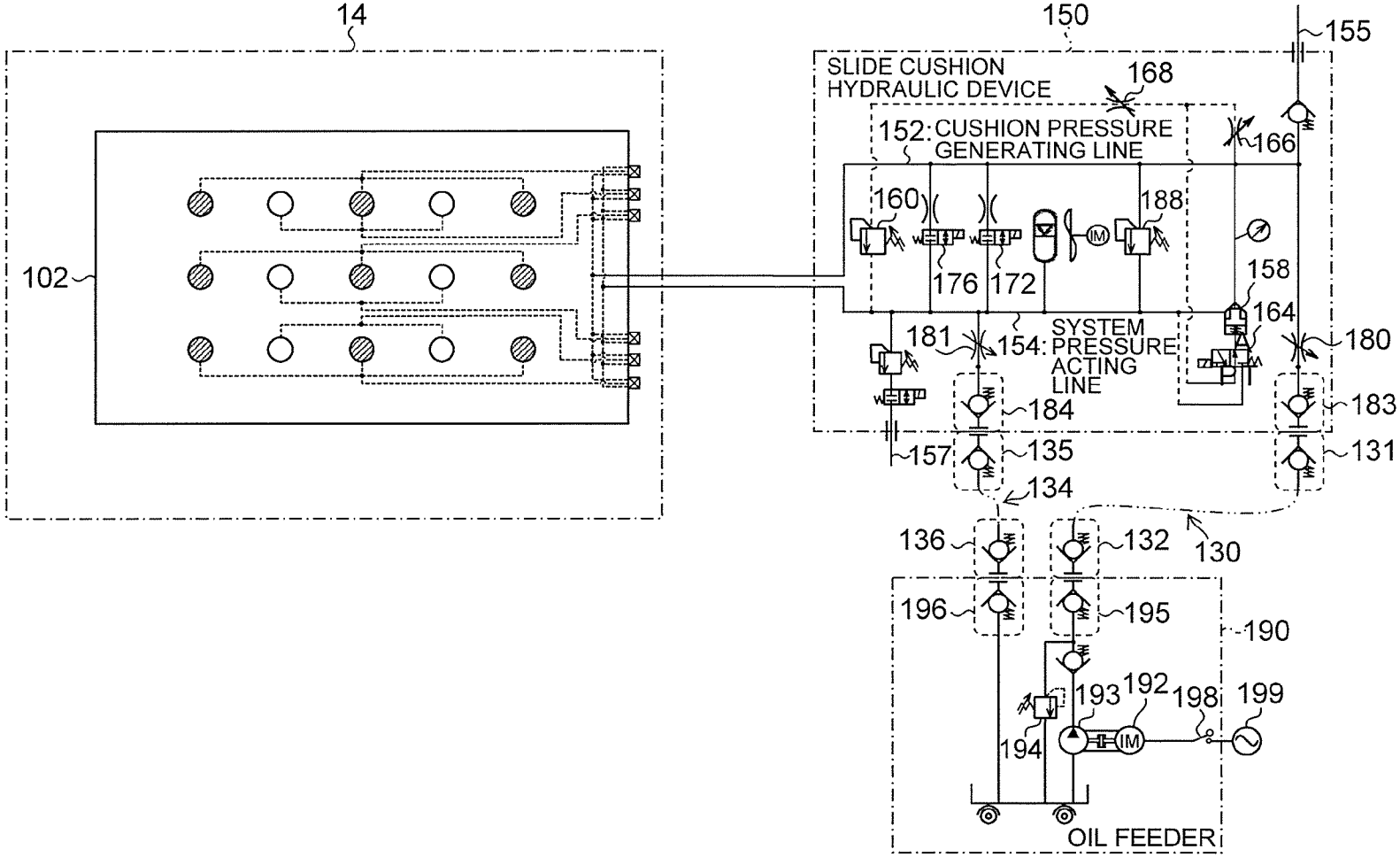
FIG. 4 illustrates a state where a slide cushion hydraulic device and an oil feeder are connected to each other through a hose.

FIG. 4 illustrates a state where the slide cushion hydraulic device 150 and an oil feeder 190 are connected to each other through hoses 130 and 134.

[Slide Cushion Hydraulic Device]

Figure 5:
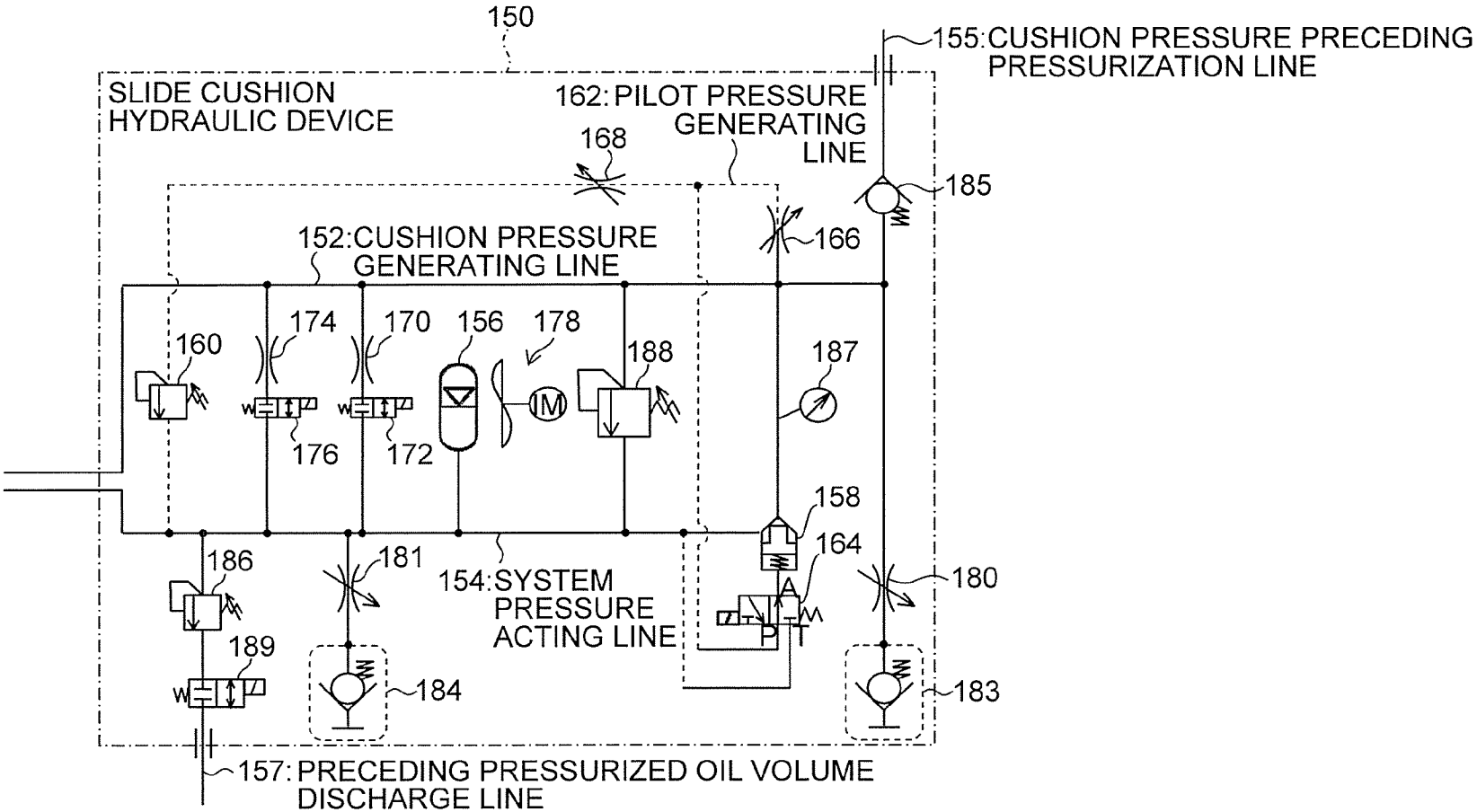
FIG. 5 is an enlarged configuration diagram of the slide cushion hydraulic device illustrated in FIG. 4.

FIG. 5 is an enlarged configuration diagram of the slide cushion hydraulic device 150 illustrated in FIG. 4.

As illustrated in FIG. 5, the slide cushion hydraulic device 150 includes: the cushion pressure generating line 152 connected to a compression chamber of a hydraulic cylinder to be used when slide cushion pressure acts through the solenoid valve group 116; the system pressure acting line 154 to which an accumulator 156 for accumulating hydraulic oil (operation fluid) under system pressure is connected; a logic valve 158 of a pilot drive type that is provided between the cushion pressure generating line 152 and the system pressure acting line 154, and that can serve as a main relief valve when the slide cushion pressure acts; and a pilot relief valve 160 that is provided between the cushion pressure generating line 152 and the system pressure acting line 154, and that generates pilot pressure for controlling the logic valve 158. At this time, it is preferable that the pilot relief valve 160 is a direct drive (non-leak) type with little leak.

The system pressure in the system pressure acting line 154 to which the accumulator 156 is connected needs to be equal to or more than pressure allowing at least the piston member 112 doubling as a cushion pad to descend to enable operation of pushing out a product and movement of the piston member 112 to a standby position (refer to FIG. 2), and preferably is set at pressure within a range from 0.3 MPa to 10.0 MPa.

The slide cushion hydraulic device 150 includes a first solenoid valve 164 that switches pressure for acting on a pilot port of the logic valve 158 to any one of the pilot pressure generated in a pilot pressure generating line 162 and the system pressure generated in the system pressure acting line 154. The pilot pressure generating line 162 is provided with throttle valves (variable throttle valves) 166 and 168 that regulate (adjust) a flow rate. In the present example, the throttle valve 168 is fully opened.

In addition, in a line between the cushion pressure generating line 152 and the system pressure acting line 154, a throttle valve 170 and a second solenoid valve 172, and a throttle valve 174 and a second solenoid valve 176, are provided in parallel. The second solenoid valves 172 and 176 each are controlled so as to be turned on and off, and are preferably a poppet type solenoid valve with little leak (non-leak) when turned off (fully closed).

The accumulator 156 is provided with a cooling device 178 to enable the accumulator 156 (hydraulic oil) to be cooled by the cooling device 178. The cooling device 178 may be provided so as to cool the system pressure acting line 154.

The cushion pressure generating line 152 and the system pressure acting line 154 include throttle valves (needle valves) 180 and 181 for feeding fluid, and check-valve-equipped joints 183 and 184 for filling with system pressure, respectively.

In addition, the cushion pressure generating line 152 is connected to the cushion pressure preceding pressurization line 155 through a check valve 185, and the system pressure acting line 154 is connected to the preceding pressurized oil volume discharge line 157 through a relief valve 186 and a fourth solenoid valve 189. The fourth solenoid valve 189 will be described later for its operation and timing of ON/OFF operation in detail.

Further, the cushion pressure generating line 152 includes a slide cushion pressure detector 187 that detects slide cushion pressure. The detector is not used for control, but for checking for action of the slide cushion pressure, and includes a Bourdon tube pressure gauge (typical pressure gauge that indicates pressure with a needle), a pressure gauge of a digital display type, and a pressure detector using a method of converting pressure into electric current or voltage.

In a line between the cushion pressure generating line 152 and the system pressure acting line 154, a relief valve 188 serving as a safety valve is provided.

[Oil Feeder]

Figure 6:
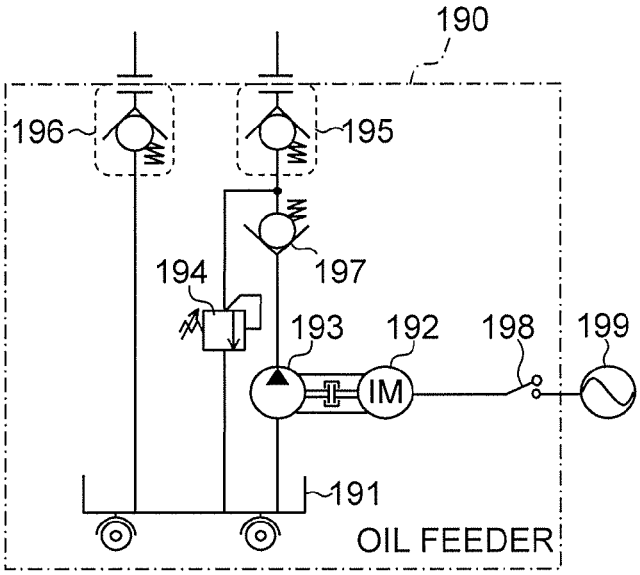
FIG. 6 is an enlarged configuration diagram of the oil feeder illustrated in FIG. 4.

FIG. 6 is an enlarged configuration diagram of the oil feeder 190 illustrated in FIG. 4.

The oil feeder 190 is a setup device that is used for feeding fluid and filling with system pressure, or for releasing the system pressure (at the time of setup preparation), and is not used during cycle functions (normal functions) of the slide cushion device 100, such as during forming molding.

Thus, the oil feeder 190 is not required to be provided for each of slide cushion devices 100, and one oil feeder can be prepared for the plurality of slide cushion devices 100 managed. In addition, a user is not required to have the oil feeder, and at least a service department at a service site may have the oil feeder.

As illustrated in FIG. 6, the oil feeder 190 includes a tank 191 that stores hydraulic oil, a hydraulic pump 193 that is driven by an induction motor 192, a relief valve 194 that serves as a safety valve, check-valve-equipped joints 195 and 196, a check valve 197, and a switch 198.

The two joints 195 and 196 of the oil feeder 190 are connected to joints 183 and 184 provided in the cushion pressure generating line 152 and the system pressure acting line 154 of the slide cushion hydraulic device 150, respectively.

The joints 195 and 196 of the oil feeder 190 are connected to the joints 183 and 184 of the slide cushion hydraulic device 150 through the hoses 130 and 134, respectively.

The hoses 130 and 134 are provided at their respective one ends with check-valve-equipped joints 131 and 132, and at their respective other ends with the joints 135 and 136, respectively, and can connect between the joints 195 and 196 on an oil feeder side, and the joints 183 and 184 on a slide cushion hydraulic device side.

When the switch 198 is turned on, the induction motor 192 of the oil feeder 190 is driven by AC current from an AC power source 199 to operate the hydraulic pump 193. Accordingly, hydraulic oil in the tank 191 can be fed to the slide cushion hydraulic device 150 through the check valve 197, the joint 195, and the hose 130, and pressure can be accumulated in the hydraulic oil. In addition, the hydraulic oil can be returned to the tank 191 from the slide cushion hydraulic device 150 through the hose 134 and the joint 196.

<Preparation and Setup (Slide Cushion Hydraulic Device Filled with Hydraulic Oil in a Pressurized Manner)>

When the slide cushion device 100 of the present example is used, there is required preparation and setup operation for filling the slide cushion hydraulic device 150 with hydraulic oil in a pressurized manner.

With reference to FIG. 4, a specific example of the preparation and setup operation will be described.

When the slide cushion hydraulic device is first used, or a hydraulic device such as a solenoid valve is replaced to cause air to flow into the hydraulic device, the slide cushion hydraulic device 150 and the oil feeder 190 are connected to each other as illustrated in FIG. 4. Subsequently, in a state where each of the pilot relief valves 160 and the relief valve 188 is set at minimum pressure while the throttle valves 166, 168, 180, and 181 of the slide cushion hydraulic device 150 are fully opened, and the first solenoid valve 164, and the second solenoid valves 172 and 176 are turned on, the switch 198 of the oil feeder 190 is turned on to drive the hydraulic pump 193 by using the induction motor 192.

This allows hydraulic oil in the slide cushion hydraulic device 150 and the oil feeder 190 (tank 191) to circulate, whereby air and contaminants in the slide cushion hydraulic device 150 are gradually removed. In addition, the throttle valve 181 on a return side is throttled to adjust pressure setting in the relief valve 194 of the oil feeder 190 so that a certain pressure acts, and after pressure in the slide cushion hydraulic device 150 is accumulated, the throttle valve 181 is opened to circulate the hydraulic oil. As a result, a ratio of air contained in the circulating hydraulic oil is increased to improve air-bleeding efficiency.

Finally, pressure setting in the relief valve 194 of the oil feeder 190 is adjusted to the system pressure, and when the pressure in the slide cushion hydraulic device 150 is accumulated to the system pressure, the throttle valve 180 on a forward side is closed, and then the switch 198 is turned off to stop the hydraulic pump 193.

After that, setting of each of the pilot relief valve 160 and the relief valve 188 in the slide cushion hydraulic device 150, as well as setting of each of the throttle valves 166 and 168 is returned to a predetermined value, and then feeding oil into the slide cushion hydraulic device 150, or filling with hydraulic oil under the system pressure, is completed. After feeding oil (filling with the system pressure), the joints 131 and 135 of the respective hoses 130 and 134 are detached from the joints 183 and 184 of the slide cushion hydraulic device 150, respectively.

In a case where the system pressure is reduced or accumulated when a user attaches or detaches a die, it is unnecessary to change setting of a hydraulic device that functions during cycle functions, such as setting of both the relief valves 160 and 188, and setting of the throttle valves 166 and 168, in the preparation and the setup operation described above.

[Operation of Mounting Die]

While it is thought that system pressure is reduced on a user side when a user mounts a die in the press machine 10, the die can be usually mounted while the system pressure acts as described below.

First, a lower die is placed on the bolster 18 in a state where an upper die, a pressing member, and a blank holder are combined while system pressure acts, and the lower die is fixed to the bolster 18. Then, the slide 14 is gradually lowered to bring a lower surface of the slide into close contact with an upper surface of the upper die. At the time, at least one of solenoid valves is opened (turned on) by a manual switch that is also previously provided and is capable of manually turning on and off at least one of the first solenoid valve 164, and the second solenoid valves 172 and 176 of the slide cushion hydraulic device 150, for setup. In this process of bringing the slide into close contact with the upper die, the system pressure acts on hydraulic cylinders to be used through slide cushion pins, and thus force corresponding to the system pressure upwardly acts on the slide 14 as reaction force.

Subsequently, the upper die is temporarily fixed to the slide 14, and the slide 14 is moved up and down several times to adjust alignment of the upper die and the lower die, and then the upper die is fixed to the slide 14.

If a user dislikes force corresponding to system pressure that acts on the slide 14 as reaction force through slide cushion pins during aforementioned operation of mounting a die, the user needs to reduce the system pressure. In this case, the user needs to have the oil feeder 190 to provide the system pressure after the die is mounted.

[Pressure Control of Slide Cushion Device]

Next, control of slide cushion pressure by the logic valve 158 and the pilot relief valve 160 will be described.

In a state where the slide cushion hydraulic device 150 is filled with hydraulic oil in a pressurized manner, when the press machine 10 is operated to allow the pressing member 120 descending together with the slide 14 to impact (collide) with the material 30 on the projecting portion of the lower die 22, the piston member 112 of the hydraulic cylinder group 110 (the piston member 112 with which the slide cushion pin 122 is to be brought into contact), serving as a slide cushion pad after the impact, relatively rises in the cylinder portion 114 with descending of the slide 14 to compress a compression chamber to increase oil pressure in the compression chamber (the cushion pressure generating line 152 connected to the compression chamber).

The oil pressure (slide cushion pressure) is controlled by the logic valve 158 and the pilot relief valve 160.

Figure 7:
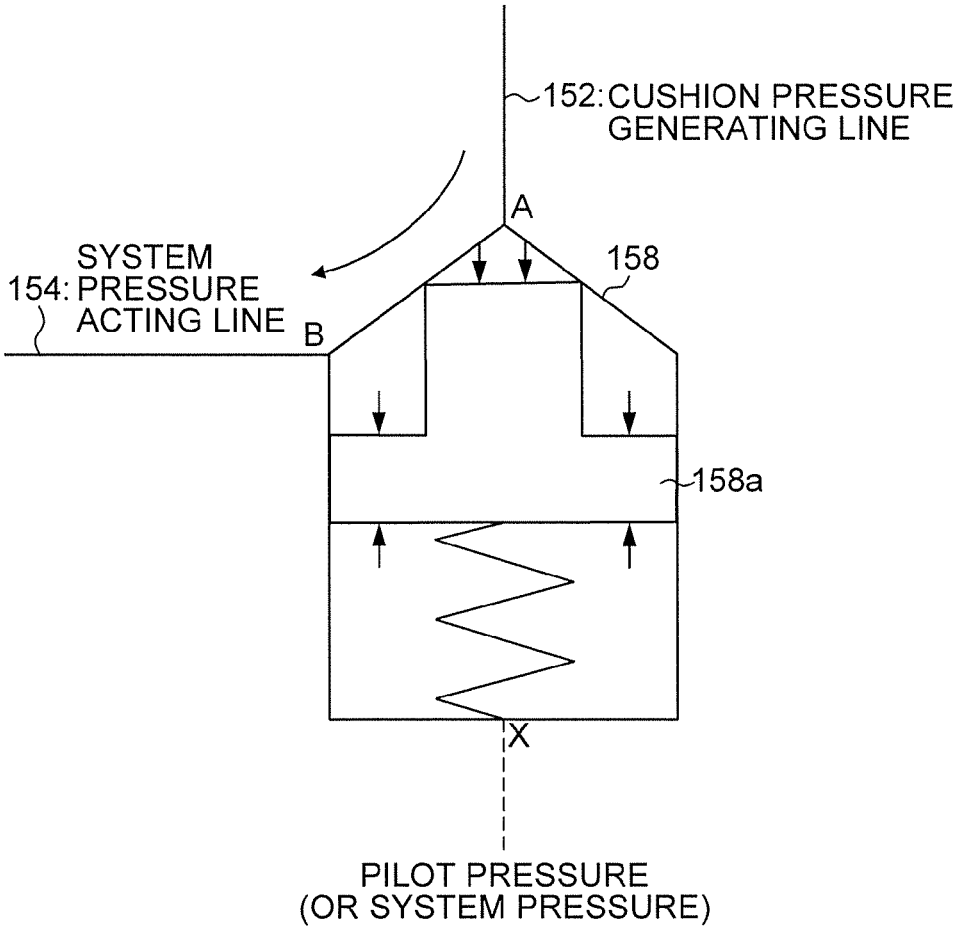
FIG. 7 is an enlarged view of the logic valve illustrated in FIG. 5 to describe operation of the logic valve.

FIG. 7 is an enlarged view of the logic valve 158 illustrated in FIGS. 4 and 5. In FIG. 7, the logic valve 158 is provided with an A port and a B port to which the cushion pressure generating line 152 and the system pressure acting line 154 are connected, respectively so that cushion pressure generated in the cushion pressure generating line 152 and system pressure are applied to the A port and the B port, respectively. In addition, the logic valve 158 is provided with a pilot port (X port) to which pilot pressure or the system pressure is to be applied by turning on and off the first solenoid valve 164.

Hereinafter, area, pressure, and spring force of each of the ports of the logic valve 158 are designated by reference characters as follow:

$A_A$ is a pressurized area of the A port;
$A_B$ is a pressurized area of the B port;
$A_X$ is a pressurized area of the X port;
$P_A$ is A port pressure (cushion pressure);
$P_B$ is B port pressure (system pressure);
$P_X$ is X port pressure (pilot pressure);
F is spring force; and
$f_Q$ is fluid force.

If Expression 1 shown below is satisfied, depressing force toward the X port is applied to a poppet 158*a* of the logic valve 158 to open the valve, and if Expression 2 below is satisfied, depressing force toward the A port is applied to the poppet 158*a* of the logic valve 158 to close the valve.

$$A_A \cdot P_A + A_B \cdot P_B > A_X \cdot P_X + F + f_Q \quad \text{[Expression 1]}$$

$$A_A \cdot P_A + A_B \cdot P_B < A_X \cdot P_X + F + f_Q \quad \text{[Expression 2]}$$

Since $A_A$, $A_B$, $A_X$, $P_B$, and F are constant in Expressions 1 and 2, the logic valve 158 is opened and closed in accordance with balance between the slide cushion pressure (A port pressure) $P_A$ and the pilot pressure (X port pressure) $P_X$, and the fluid force $f_Q$ acting in a direction of interfering with a flow rate of oil following through the valve.

The pilot pressure $P_X$ is also adjustable by pressure setting in the pilot relief valve 160, and thus the logic valve 158 can adjust the slide cushion pressure in accordance with the pilot pressure (relief pressure) set in the pilot relief valve 160.

[Controller]

Figure 8:
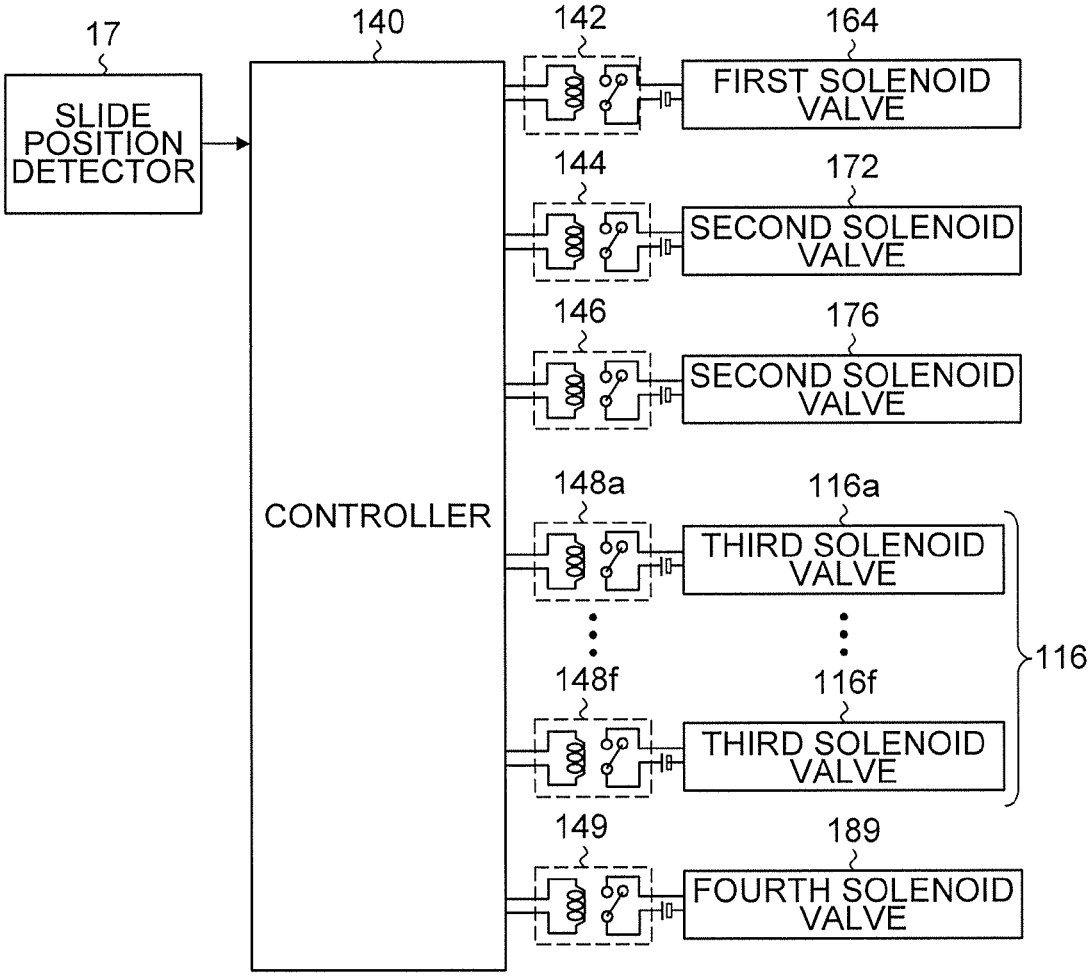
FIG. 8 is a block diagram illustrating an embodiment of a controller used in the slide cushion device.

FIG. 8 is a block diagram illustrating an embodiment of a controller 140 used in the slide cushion device 100.

The controller 140 illustrated in FIG. 8 controls turning on and off of the first solenoid valve 164 and the second solenoid valve 172 and 176 of the slide cushion hydraulic device 150 illustrated in FIG. 4 and the like, the solenoid valve group 116 (third solenoid valves 116*a* to 116*f*) disposed in the board 102, and the fourth solenoid valve 189. The controller 140 controls turning on and off of relays 142, 144, 146, and 148*a* to 148*f* in response to a signal of position of the slide 14 detected by the slide position detector 17, and outputs driving current to the first solenoid valve 164, the second solenoid valves 172 and 176, the third solenoid valves 116*a* to 116*f*, and the fourth solenoid valve 189, through the relays 142, 144, 146, 148*a* to 148*f*, and 149, turning on and off of the relays being controlled, thereby individually controlling turning on and off of the first solenoid valve 164, the second solenoid valves 172 and 176, the third solenoid valves 116*a* to 116*f*, and the fourth solenoid valve 189.

Since the controller 140 of the present example performs simple control such as individual control of turning on and off of the first solenoid valve 164, the second solenoid valves 172 and 176, and the third solenoid valves 116*a* to 116*f*, a special control device is unnecessary. Thus, a part of a controller of the press machine 10 (a programmable logic controller (PLC)) can be used, and a cam switch that is opened to a customer in the press machine to drive a peripheral device of the press machine, and a device associated with a die can be used, for example, whereby the slide cushion device 100 has no increase in cost.

In the third solenoid valves 116*a* to 116*f*, the third solenoid valve corresponding to a hydraulic cylinder to be used when slide cushion pressure acts is always excited (turned on) to connect a compression chamber of the hydraulic cylinder to be used when the slide cushion pressure acts to the cushion pressure generating line 152, and the other third solenoid valve is always demagnetized (turned off) to connect a compression chamber of a hydraulic cylinder that is not used when the slide cushion pressure acts to the system pressure acting line 154. Thus, manual type changeover valves can be used instead of the third solenoid valves 116*a* to 116*f*.

In addition, since the third solenoid valves 116*a* to 116*f* each are not an essential component in the slide cushion device 100, each compression chamber of the hydraulic cylinder group 110 may be directly connected to the cushion pressure generating line 152. Using the third solenoid valves 116*a* to 116*f* enables a compression chamber of a hydraulic cylinder that is not used when slide cushion pressure acts to be detached from the cushion pressure generating line 152 (to be connected to the system pressure acting line 154), whereby there is an advantage in that volume of hydraulic oil pressurized when the slide cushion pressure acts can be reduced to improve response of cushion pressure.

The controller 140 controls (turns off) the first solenoid valve 164 so that pilot pressure is applied to the pilot port of the logic valve 158 during a descending period of the slide 14, and controls (turns off) the second solenoid valves 172 and 176 so that the second solenoid valves 172 and 176 are opened during a rising period of the slide 14. In addition, the controller 140 controls the fourth solenoid valve 189 so that it is turned on in a predetermined period before slide cushion pressure starts to act (a predetermined period in which system pressure in the slide cushion hydraulic device 150 has a minimum value) to enable increased pressure oil to be discharged into the preceding pressurized oil volume discharge line 157 through the relief valve 186 and the fourth solenoid valve 189.

Specific timing of controlling turning on and off of the first solenoid valve 164, the second solenoid valves 172 and 176, and the fourth solenoid valve 189 by the controller 140 will be described later. The controller 140 may control turning on and off of the first solenoid valve 164, the second solenoid valves 172 and 176, and the fourth solenoid valve 189, in accordance with a crank angle detected by an encoder provided in a crankshaft crank.

<Function of Slide Cushion Device in One Cycle Period of Press Machine>

Subsequently, each function of the slide cushion device 100 in one cycle period of the press machine 10 will be described.

Figure 9:
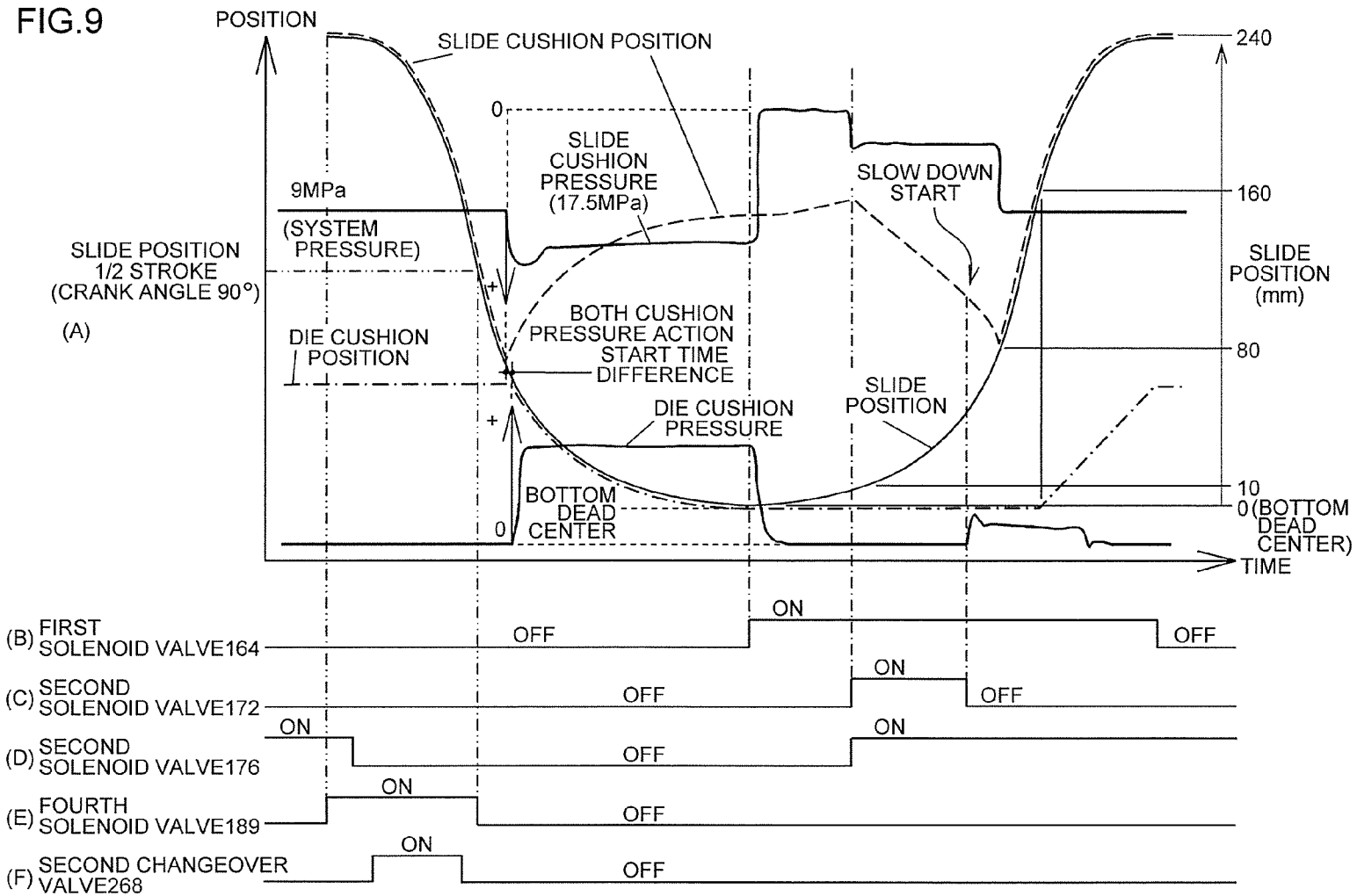

Portion (A) of FIG. 9 is a waveform chart illustrating position of the slide 14 (slide position), slide cushion position, position of the die cushion pad 210 (die cushion position), slide cushion pressure, system pressure, and die cushion pressure, in one cycle period of the press machine 10. The slide cushion position illustrated in Portion (A) of FIG. 9 indicates position of the piston member 112 of the hydraulic cylinder, serving as a slide cushion pad. When the piston member 112 is positioned at a lower end of the cylinder portion 114, the slide cushion position and the slide position are indicated at the same position, and when the slide 14 is positioned at the bottom dead center, it is indicated that relative displacement between the slide cushion position and the slide position is maximum.

Portions (B) to (F) of FIG. 9 are timing charts illustrating timing of ON/OFF operation of the first solenoid valve 164, the second solenoid valves 172 and 176, the fourth solenoid valve 189, and a second changeover valve 268 described later, respectively.

In the present embodiment, nine hydraulic cylinders (hydraulic cylinders 110*a*, 110*d*, and 110*e*, hydraulic cylinders 110*k*, 110*m*, and 110*o*, and hydraulic cylinders 110*f*, 110*i*, and 110*j* (refer to FIG. 4)) are used for slide cushion pressure action in fifteen hydraulic cylinders of the hydraulic cylinder group 110, and the slide cushion pins 122 provided in the pressing member 120 are adjusted in number (nine) and position corresponding one-to-one to the nine hydraulic cylinders described above to be disposed.

The third solenoid valves 116*a*, 116*e*, and 116*f* in the solenoid valve group 116 (third solenoid valves 116*a* to 116*f*), corresponding to the hydraulic cylinders 110*a*, 110*d*, and 110*e*, the hydraulic cylinders 110*k*, 110*m*, and 110*o*, and the hydraulic cylinders 110*f*, 110*i*, and 110*j*, respectively, are always excited, and the third solenoid valves 116*b*, 116*c*, and 116*d* corresponding to the other hydraulic cylinders are always demagnetized.

<Slide at Top Dead Center (When Operation Starts and Stops, or When Passing Through Top Dead Center During Operation)>

When the slide 14 is positioned at the top dead center, at least one of the second solenoid valves 172 and 176 (the second solenoid valve 176 in the present example) is excited (turned on) (refer to Portion (D) of FIG. 9), and the system pressure acting line 154 to which the accumulator 156 is connected communicates with a compression chamber of each of the selected nine hydraulic cylinders of the hydraulic cylinders 110*a*, 110*d*, and 110*e*, the hydraulic cylinders 110*k*, 110*m*, and 110*o*, an the hydraulic cylinders 110*f*, 110*i*, and 110*j*, through the second solenoid valve 176, the cushion pressure generating line 152, and the third solenoid valve 116*a*, 116*e*, and 116*f* in an excited state.

In this state, a system pressure of about 9 MPa acts in the system pressure acting line 154. The system pressure acting line 154 is under minimum pressure in the slide cushion hydraulic device 150, but does not have a device with a limited value of pressure (low allowable pressure) in strength (structure), such as a hydraulic pump (a case drain portion, and an oil-seal portion), and thus a large system pressure (9 MPa in the present example) can act in the system pressure acting line 154 depending on whether a pipeline thereof secures strength. This action will be described later, and efficiently increases slide cushion pressure with a quick response.

Finally, a pressure of 9 MPa is applied to the compression chamber of each of the nine hydraulic cylinders described above. The present slide cushion device 100 includes the hydraulic cylinder group 110 of fifteen hydraulic cylinders, and when a maximum working pressure of 21 MPa is applied to the cylinder compression chamber of each of the hydraulic cylinders by using all of the hydraulic cylinders, a maximum thrust of 1,000 kN (1.5 times or more a maximum slide cushion force on specifications) can be applied, the specifications showing that maximum slide cushion force is 600 kN (available maximum slide cushion force by selecting slide cushion pins is 600 kN).

Where an area of the cylinder portion 114 of each of the hydraulic cylinders is designated as A ($m^2$), A=1000/(21×15) from the following: 21 (MPa)×15 (hydraulic cylinders)×A ($m^2$)=1000 (kN).

Thus, in a state where a pressure of 9 MPa is applied to the compression chamber of each of the nine hydraulic cylinders, 9 (MPa)×9(hydraulic cylinders)×A≈257 (kN), that is, a force of about 257 kN is applied to the hydraulic cylinders (machine) through the piston member 112. In the present example, a slide cushion force of 500 kN (equivalent to 17.5 MPa) is expected (intended) to act during forming by using the slide cushion pins 122 at selected nine places (nine pins). Then, the slide cushion pins 122 at unnecessary six places (six pins) are not used (not inserted into the cushion pin hole 115), the third solenoid valves 116*b*, 116*c*, and 116*d* are not excited, and the compression chamber of each of the hydraulic cylinders 110*b*, 110*d*, 110*g*, 110*i*, 110*l*, and 110*n* always communicates with the system pressure acting line 154 in a cycle (during forming and non-forming). This enables waste of pressurizing volume of unnecessary cylinder compression chambers to be eliminated when slide cushion pressure is applied, and thus contributes to reduction in response time of increasing slide cushion pressure.

<Slide During Descending (Before Forming)>

When the slide reaches a certain (predetermined) slide position before forming starts (the pressing member 120 is brought into contact with the material (blank) 30), excitation of the second solenoid valve 176 is released (turned off) (refer to Portion (D) of FIG. 9). In this state, a pressure of 9 MPa is always applied to a compression chamber of each of nine hydraulic cylinders to be used for slide cushion pressure action.

<Slide During Descending (Start of Forming to End of Forming)>

[Slide Cushion Pressure Action]

At the time when the slide 14 descends and the pressing member 120 is brought into contact with the material 30 held by the blank holder 202 while being in contact with an upper surface of the lower die (punching die) 22, press forming is started.

First, downward movement of the pressing member 120 is restricted, and the piston member 112 of each of nine hydraulic cylinders interlocking with the slide cushion pins 122 tends to be pushed back upwardly through the slide cushion pins 122 interlocking with the pressing member 120. In the cushion pressure generating line 152 compressed by the piston member 112, interaction among the logic valve 158, the throttle valve 166, the throttle valve 168, and the pilot relief valve 160 generates a slide cushion pressure of 17.5 MPa.

That is, pressure generated in the cushion pressure generating line 152 by pressed by the piston member 112 causes an oil flow (a flow rate of pressure oil flowing per unit time) from the throttle valve 166 to the system pressure acting line 154 through the throttle valve 168 and the pilot relief valve 160. Accordingly, pilot pressure for conducting opening and closing of a poppet of the logic valve 158 is generated between the throttle valves 166 and 168 (pilot pressure generating line 162). The pilot pressure is generated in accordance with pressure in the cushion pressure generating line 152. The poppet of the logic valve 158 receives slide cushion pressure applied to a pressure-receiving area on its cushion pressure generating line side, system pressure applied to a pressure-receiving area on its system pressure acting line side, pilot pressure applied to a pressure-receiving area on its pilot pressure acting line side through the first solenoid valve 164, and force of a spring in the logic valve 158, and the logic valve 158 receives fluid force acting in a direction of interfering (closing the valve) with a flow of pressure oil from the cushion pressure generating line 152 to the system pressure acting line 154, while a balance among them is kept. A poppet position (opening) of the logic valve 158 is held in accordance with speed of the piston member 112 pushed back (held substantially constant if the speed is constant), and the slide cushion pressure is generated in a series of the actions.

In the present example, the pilot relief valve 160 is adjusted so that pilot pressure equivalent to 17.5 MPa required to apply a predetermined slide cushion force of 500 kN is generated. At the time, the slide cushion pressure needs to be increased only by a differential pressure of 8.5 MPa from a pressure of 9 MPa previously applied to a pressure of 17.5 MPa, and thus a time of increasing the slide cushion pressure can be reduced.

This action can be achieved because the slide cushion hydraulic device 150 (between the cushion pressure generating line 152 and the system pressure acting line 154 under minimum pressure) has no hydraulic pump (is not provided), and thus a pressure value (in strength) that can be applied to a low-pressure portion is not restricted. In addition, the action is feasible without requiring extra power for driving a hydraulic pump, and thus achieves high efficiency. This action is important to reliably increase the slide cushion pressure prior to die cushion force described later that acts at substantially identical timing with that of the slide cushion pressure.

[Die Cushion Pressure Action]

The slide 14 further descends slightly, and die cushion pressure starts to act at the time when the upper die (dicing die) 20 is brought into contact with the blank holder 202 through the material 30 (at the time of a final stage of a step of increasing pressure in which about 75% of increase in pressure is finished after the slide cushion pressure starts to act). While control of the die cushion pressure does not relate to the present invention, it will be simply described later.

Then, forming of the material 30 is performed for drawing elements, according to a shape of the die (the upper die 20, the pressing member 120, the lower die 22, and the blank holder 202), until the slide 14 reaches the bottom dead center, while the material 30 is pressurized by the slide cushion force that acts in advance, so as to be nipped between the pressing member 120 and the projecting portion of the lower die 22, and while a contour of the material 30 is pressurized by die cushion force so as to be nipped between the blank holder 202 and a contour portion of the upper die 20. The forming proceeds so that no primary drawn wrinkle (cylindrical outside surface) is generated by the die cushion force, and that no defect such as wrinkles (partially) and cracks is generated by the slide cushion force during drawing.

<Slide During Rising>

<Reduction in Slide Cushion Pressure, Reduction in Die Cushion Pressure Along with Locking, and Locking>

[Reduction in Slide Cushion Pressure]

At time when the slide 14 descends and reaches the bottom dead center or a position slightly in front of the bottom dead center (near the bottom dead center), turning on the first solenoid valve 164 (refer to Portion (B) of FIG. 9) causes the poppet of the logic valve 158 to move in a direction of being opened because pilot pressure acting in a direction of closing the poppet is released into the system pressure acting line 154, and then slide cushion pressure is reduced to second system pressure slightly more than system pressure (first system pressure), the second system pressure being equal to a total of first system pressure and cracking pressure equivalent to spring force of the logic valve 158. At this stage, the poppet of the logic valve 158 is closed.

At the time when the slide cushion pressure is reduced to the second system pressure, die cushion pressure is also reduced to a low-pressure value of the order of 0.5 MPa substantially in synchronization with the slide cushion pressure, and the slide 14 is stopped (locked) at a position below the slide bottom dead center position (near the bottom dead center).

[Slide Cushion Locking]

When the slide 14 turns to rising from the bottom dead center and rises from the bottom dead center by a slight amount of about 1 mm, the slide cushion pressure is reduced to almost 0 MPa due to an action of closing the logic valve 158 to cause the slide cushion pressure to be interrupted from the system pressure acting line 154, and an action of releasing force of pressing the piston member 112 through the slide cushion pins 122, and then the slide 14 is stopped (locked) at a position near a slide position of 1 mm (near the bottom dead center).

[Pushing Out (Knocking Out) Shaped Product from Upper Die by Slide Cushion Device]

At the time when the slide 14 further rises and reaches a position 10 mm above the bottom dead center, turning on the second solenoid valves 172 and 176 (refer to Portions C and D of FIG. 9) causes system pressure (9 MPa) in the system pressure acting line 154 to act in the cushion pressure generating line 152 through the throttle valves 170 and 174. Then an oil flow is generated from the system pressure acting line 154 to the cushion pressure generating line 152, and the piston member 112 acts to push out (knock out) a product of a height of about 70 mm downward. At the time when the piston member 112 descends by three quarters of a pushing-out stroke in a process of the pushing-out, the second solenoid valve 172 is turned off to reduce pushing-out speed, and at the time when the slide 14 rises to about 80 mm above the bottom dead center, the piston member 112 reaches a projecting (machine) limit position. Then, the product is "gently" placed on the lower die 22 without shock. In the state, the die cushion pad 210 is still stopped at a position below the slide bottom dead center.

[Knocking Out of Product by Die Cushion Device 200]

At the time when the slide 14 further rises to about 160 mm above the bottom dead center, the die cushion pad 210 rises while knocking out the product to an initial position (equal to a die cushion starting position and a product conveyance position) through the blank holder 202.

As described above, the slide cushion device 100 first stops the piston member 112 serving as a slide cushion pad near the bottom dead center for a minimum necessary time without crushing the product between the pressing member 120 and the lower die 22, and then "gently" puts down the product on the lower die 22. Subsequently, the die cushion device 200 further stops the die cushion pad 210 near the bottom dead center so that the product is not crushed between the blank holder 202 and the upper die 20, and then the product is knocked out to the product conveyance position.

<Slide Top Dead Center>

At the time when the slide 14 further rises and reaches (returns to) the top dead center, the first solenoid valve 164 is turned off (refer to Portion (B) of FIG. 9).

A hydraulic pump is considered as a basic essential element in typical common-sense knowledge of hydraulic drive, and is also considered as a root of all evil in a specific hydraulic drive form using a kind of "spring" function such as the present slide cushion. That is, if a hydraulic pump is provided for pressurization based on the premise that a hydraulic pump is necessary, pressure on a low-pressure side (suction side) of a portion where the hydraulic pump is provided is limited to about 1 MPa at most because the hydraulic pump has a weak portion in strength. Thus, it is required to repeat pumping action for pressurizing a cushion pressure generating line by using power as necessary and reducing pressure therein if pressure is unnecessary, during machine operation.

If no hydraulic pump is provided like the slide cushion hydraulic device 150, pressure is not limited on a low-pressure side, and thus the accumulator 156 on the low-pressure side can hold high pressure. At the time, the held pressure is equivalent to an initial amount of compression of a "hydraulic spring". When force is applied from the outside as a cushion, the "hydraulic spring" is further compressed to store elastic energy. Then, when the "hydraulic spring" is returned to an initial position while pushing out a product, the stored elastic energy is discharged. This is repeated during machine operation to achieve high efficiency. That is, the slide cushion hydraulic device 150 is a hydraulic drive form without a hydraulic pump that can be achieved by using a "spring" for the reason described above.

<Die Cushion Hydraulic Device>

Figure 10:
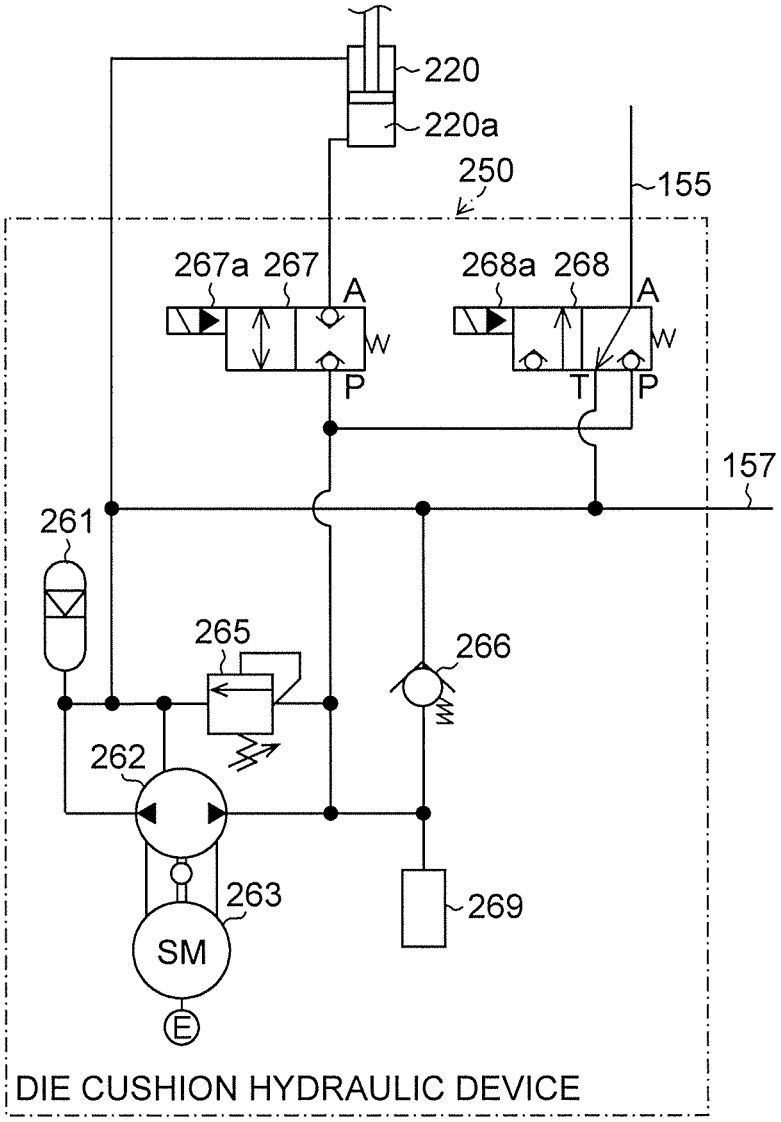
FIG. 10 is a circuit diagram illustrating an embodiment of the die cushion hydraulic device illustrated in FIG. 1.

FIG. 10 is a circuit diagram illustrating an embodiment of the die cushion hydraulic device 250 illustrated in FIG. 1. While the die cushion hydraulic device 250 is equivalent to that disclosed in Japanese Patent Application Laid-Open No. 2006-315074, there is a difference in that there are added a 2-port-2-position solenoid changeover valve (hereinafter referred to as simply a "first changeover valve") 267, and a 3-port-2-position solenoid changeover valve (hereinafter referred to as simply a "second changeover valve") 268. In addition, the die cushion hydraulic device 250 of the present embodiment can supply pressure oil to the slide cushion device 100 through the cushion pressure preceding pressurization line 155, and receives hydraulic oil discharged from the slide cushion device 100 through the preceding pressurized oil volume discharge line 157.

As illustrated in FIG. 10, the die cushion hydraulic device 250 includes an accumulator 261, a hydraulic pump/motor 262, a servo motor 263 connected to a rotating shaft of the hydraulic pump/motor 262, a relief valve 265, a check valve 266, a first changeover valve 267, and a second changeover valve 268.

The accumulator 261 not only serves as a tank in which low gas pressure is set, but also serves to supply oil under substantially constant low pressure to a port P of each of the first changeover valve 267 and the second changeover valve 268 through the check valve 266 to easily increase pressure of pressure oil when the hydraulic pump/motor 262 is driven. In addition, the preceding pressurized oil volume discharge line 157 is connected to the accumulator 261. The accumulator 261 is connected to a low-pressure line under pressure less than system pressure of the system pressure acting line 154 of the slide cushion hydraulic device 150.

One port (discharge port) of the hydraulic pump/motor 262 is connected to the port P of each of the first changeover valve 267 and the second changeover valve 268, and the other port is connected to the accumulator 261. The hydraulic pump/motor 262 is driven by the servo motor 263 to supply pressure oil to the port P of the first changeover valve 267 and the port P of the second changeover valve 268.

The relief valve 265 is provided as means that operates to prevent a hydraulic device from breaking when abnormal pressure occurs. In FIG. 10, reference numeral 269 represents a pressure detector corresponding to a die cushion force detector, and the pressure detector 269 detects pressure (die cushion pressure) in a pressure generating chamber 220*a* of the hydraulic cylinder 220.

When a solenoid 267*a* of the first changeover valve 267 is excited (the first changeover valve 267 is turned on), the first changeover valve 267 is opened so that pressure oil can be supplied to the pressure generating chamber 220*a* of the hydraulic cylinder 220 from the hydraulic pump/motor 262 through the first changeover valve 267, or so that pressure oil discharged from the pressure generating chamber 220*a* of the hydraulic cylinder 220 when die cushion pressure acts can flow into the hydraulic pump/motor 262 through the first changeover valve 267.

Conversely, when the solenoid 267*a* of the first changeover valve 267 is demagnetized (the first changeover valve 267 is turned off), the first changeover valve 267 is closed to hold die cushion pad 210 and the like against their self-weight.

When a solenoid 268*a* of the second changeover valve 268 is excited (the second changeover valve 268 is turned on), the second changeover valve 268 is switched so that pressure oil can be supplied to the slide cushion hydraulic device 150 from the port P through the port A and the cushion pressure preceding pressurization line 155.

Conversely, when the solenoid 268*a* of the second changeover valve 268 is demagnetized (the second changeover valve 268 is turned off), supply of pressure oil to the slide cushion hydraulic device 150 from the die cushion hydraulic device 250 is interrupted.

The first changeover valve 267 and the second changeover valve 268 are controlled to be turned on and off, for example, on the basis of a signal indicating a crank angle of a crank mechanism so that the first changeover valve 267 is turned on and the second changeover valve 268 is turned off during a die cushion function period in which the die cushion device 200 functions, in one cycle period of a press machine, and so that the first changeover valve 267 is turned off and the second changeover valve 268 is turned on during a period other than the die cushion function period, in the one cycle period of the press machine. The second changeover valve 268 will be described later for its timing of ON/OFF operation in detail.

Die cushion force control during the die cushion function period is performed by controlling torque of the servo motor 263 on the basis of a predetermined die cushion pressure command and pressure (die cushion pressure) in the pressure generating chamber 220*a* of the hydraulic cylinder 220, detected by the pressure detector 269, so that the die cushion pressure becomes pressure corresponding to the die cushion pressure command. This die cushion force control is performed in a manner similar to control disclosed in Japanese Patent Application Laid-Open No. 2006-315074, and is not an essential of the present invention, and thus detailed description of the control is eliminated.

While the slide cushion hydraulic device 150 can function without pressure oil supplied from an external hydraulic device, before slide cushion pressure starts to act and when all of the first solenoid valve 164 and the second solenoid valves 172 and 176 are turned off, supplying pressure oil to the slide cushion hydraulic device 150 from the external hydraulic device (the die cushion hydraulic device 250 of the present example) through the cushion pressure preceding pressurization line 155 pressurizes the cushion pressure generating line 152 (or a compression chamber of a hydraulic cylinder) to pressure higher than system pressure (9 MPa is the present example) in advance. This enables further reduction in response time of increasing pressure in a compression chamber of each hydraulic cylinder when the slide cushion pressure acts to desired cushion pressure (17.5 MPa in the present example).

At the time, the hydraulic oil flowing from the cushion pressure preceding pressurization line 155 is discharged into a low-pressure line of the die cushion hydraulic device 250 after passing through the preceding pressurized oil volume discharge line 157 via the relief valve 186 and the fourth solenoid valve 189 through cycles.

Portions (E) and (F) of FIG. 9 respectively illustrate an example of operation timing of the second changeover valve 268 that enables supply of pressure oil through the cushion pressure preceding pressurization line 155, and an example of operation timing of the fourth solenoid valve 189 that enables discharge of pressure oil increased in volume through the preceding pressurized oil volume discharge line 157.

When hydraulic oil for preceding pressurization is supplied to the slide cushion hydraulic device 150 from the external hydraulic device (the die cushion hydraulic device 250 of the present example) through the cushion pressure preceding pressurization line 155, an amount of the hydraulic oil in the slide cushion hydraulic device 150 increases (system pressure increases), and then the hydraulic oil increased in amount is discharged from the preceding pressurized oil volume discharge line 157 through the relief valve 186 and the fourth solenoid valve 189 (refer to FIG. 5).

The system pressure in the slide cushion hydraulic device 150 increases when the slide cushion pressure acts, and a maximum value of system pressure to be increased depends on a slide cushion stroke (determined for each die used).

Meanwhile, a minimum value of the system pressure in the slide cushion hydraulic device 150 does not depend on the slide cushion stroke, and is a constant value when cushion is on standby (at the time of non-forming and non-stroking).

Thus, in a period where cushion is on standby and the system pressure in the slide cushion hydraulic device 150 becomes minimum, pressure oil is released to hold the system pressure to be increased by hydraulic oil for preceding pressurization at a constant value.

Since the cushion is on standby when at least a crank angle of press machine is within a range from 0-degree (top dead center) to 90-degree, the fourth solenoid valve 189 is controlled so as to be opened in this period by using a cam switch or the like, as illustrated in Portion (E) of FIG. 9, thereby releasing the pressure oil. At that time, relief setting pressure of the upstream relief valve 186 is set to the system pressure (minimum value) of the slide cushion hydraulic device 150.

The hydraulic oil for preceding pressurization needs to be supplied in a period where the second solenoid valves 172 and 174 are turned off before the slide cushion pressure starts to act. Thus, the die cushion hydraulic control device 250 causes the second changeover valve 268 to be turned on in the period above, as illustrated in Portion (F) of FIG. 9, thereby supplying the hydraulic oil for preceding pressurization.

[Others]

When the logic valve 158 releases the slide cushion pressure of pressure oil to the system pressure while the slide cushion pressure acts, hydraulic oil generates heat due to squeezing action of the pressure oil, caused by the logic valve 158.

In the present example, as illustrated in FIG. 5, there is provided the cooling device 178 that blows air on the accumulator 156 with a large surface area to cool the accumulator 156 (hydraulic oil). The cooling device 178 is an air-cooled cooling device using a fan, but is not limited to the air-cooled cooling device. Thus, a water-cooled cooling device that cools hydraulic oil by circulating cooling water may be available. If the slide cushion device 100 is less used, it is possible to cool hydraulic oil by using only natural heat dissipation without providing a cooling device, whereby a more inexpensive device can be achieved.

While all energy (energy in proportion to the product of an amount of oil passing through a valve per unit time and differential pressure between cushion pressure and system pressure) of pressure oil flowing into the system pressure acting line 154 from the cushion pressure generating line 152 through the logic valve 158 is converted into heat with slide cushion pressure action being a main function, the slide cushion hydraulic device 150 includes no hydraulic pump, and thus there is no heat caused by an auxiliary function related to hydraulic pump. Since only loss in pressure required actually is converted into heat, even a simple cooling unit is available.

While the board (block) in which the hydraulic cylinder group is integrally formed is provided immediately below the slide in the present embodiment, the board may constitute a part of the slide. In addition, the number and placement of hydraulic cylinders of the hydraulic cylinder group integrally formed in the board are not limited to those of the embodiment illustrated in FIG. 3, and various numbers and placements are available. It is preferable that the number of hydraulic cylinders of the hydraulic cylinder group is ten or more.

In the present embodiment, while the slide cushion device in which oil is used for operation fluid is described, besides this, water or another liquid may be used. That is, while the form of using the hydraulic cylinder and the slide cushion hydraulic device is described in the example of the present application, besides this, it is needless to say that a fluid-pressure cylinder and a slide cushion fluid-pressure device, using water or another liquid, are available in the present invention.

In addition, the slide cushion device according to the present invention can be used for not only a crank press but also any type of press machine such as primarily a mechanical type, and a hydraulic press, in short, can be used for any machine in which a press and a slide are vertically moved so that a material is press-formed.

In addition, the present invention is not limited the embodiment above, and therefore it is needless to say that various modifications and variations are possible within a range without departing from the essence of the present invention.

What is claimed is:

1. A slide cushion device of a press machine, comprising:

a plurality of hydraulic cylinders integrally formed in a board included in a slide of the press machine, or in a board provided immediately below the slide;

a pressing member that is disposed in a recessed portion of an upper die that vertically moves together with the slide, in a vertically movable manner, and that presses a material with a projecting portion of a lower die facing the upper die;

a plurality of cushion pins that is provided in the pressing member and penetrates the upper die to be brought into contact with a piston member of the hydraulic cylinder, wherein a number of the plurality of cushion pins is less than a number of hydraulic cylinders disposed in a plane of projection of the recessed portion of the upper die; and a slide cushion hydraulic device that controls at least hydraulic pressure that is to be supplied to a compression chamber of the hydraulic cylinder with which the cushion pins are to be brought into contact.

2. The slide cushion device of a press machine according to claim 1, wherein the number of hydraulic cylinders N is ten or more.

3. The slide cushion device of a press machine according to claim 2, wherein total maximum thrust N×f of the N hydraulic cylinders is 1.5 times or more maximum slide cushion force on specifications, where maximum thrust of one of the plurality of hydraulic cylinders is indicated as f.

4. The slide cushion device of a press machine according to claim 1, wherein the slide cushion hydraulic device includes a cushion pressure generating line, and a system pressure acting line in which operation fluid is held under a predetermined system pressure, and the compression chamber of each of the plurality of hydraulic cylinders is connected to the cushion pressure generating line or the system pressure acting line through any one of a plurality of changeover valves equal in number to the plurality of hydraulic cylinders, or is connected to the cushion pressure generating line or the system pressure acting line through any one of the plurality of changeover valves less in number than the plurality of hydraulic cylinders.

5. The slide cushion device of a press machine according to claim 1, wherein the slide cushion hydraulic device includes a cushion pressure generating line, and a system pressure acting line in which operation fluid is held under a predetermined system pressure, and the compression chamber of each of the plurality of hydraulic cylinders is directly connected to the cushion pressure generating line.

6. The slide cushion device of a press machine according to claim 4, wherein an accumulator configured to hold the operation fluid under system pressure within a range from 0.3 MPa to 10.0 MPa is connected to the system pressure acting line.

7. The slide cushion device of a press machine according to claim 4, wherein the slide cushion hydraulic device includes:

a logic valve of a pilot drive type that is provided between the cushion pressure generating line and the system pressure acting line, and that is operable as a main relief valve when slide cushion pressure acts, and a pilot relief valve that is provided between the cushion pressure generating line and the system pressure acting line to generate pilot pressure that controls the logic valve.

8. The slide cushion device of a press machine according to claim 7, wherein the slide cushion hydraulic device includes a first solenoid valve that switches pressure to be applied to a pilot port of the logic valve to any one of the pilot pressure and the system pressure.

9. The slide cushion device of a press machine according to claim 8, wherein the slide cushion hydraulic device includes a second solenoid valve that is provided between the cushion pressure generating line and the system pressure acting line to open and close a line between the cushion pressure generating line and the system pressure acting line.

10. The slide cushion device of a press machine according to claim 9, further comprising:

a controller configured to control the first solenoid valve and the second solenoid valve, wherein the controller controls the first solenoid valve so that the pilot pressure is applied to the pilot port of the logic valve during a descending period of the slide, and the second solenoid valve so that the second solenoid valve is opened during a rising period of the slide.

11. The slide cushion device of a press machine according to claim 7, wherein the cushion pressure generating line is connected through a check valve to a cushion pressure preceding pressurization line through which operation fluid pressurized by an external hydraulic device can be supplied, and the system pressure acting line is connected through a relief valve to a preceding pressurized fluid volume discharge line.

12. The slide cushion device of a press machine according to claim 4, wherein the slide cushion hydraulic device is filled with pressurized operation fluid, and no hydraulic pump for pressurizing and supplying the operation fluid is provided between the cushion pressure generating line and the system pressure acting line.

* * * * *